US005419792A

United States Patent [19]

King et al.

[11] Patent Number: 5,419,792

[45] Date of Patent: May 30, 1995

[54] METHOD AND APPARATUS FOR COOLING A WORKPIECE

[75] Inventors: Dennis G. King, Wrightsville Beach, N.C.; Robert G. Baran, Clifton Park, N.Y.; Larry W. Plemmons, Fairfield, Ohio; Nancy A. Sullivan, Williamsburg, Ohio; Glenn C. Culbertson, Mason, Ohio; Shesh K. Srivatsa; Thomas M. Gately, both of Cincinnati, Ohio

[73] Assignee: General Electric Company, Cincinnati, Ohio

[21] Appl. No.: 286,712

[22] Filed: Jul. 25, 1994

[51] Int. Cl.[6] ..... C21D 9/00

[52] U.S. Cl. ..... 148/637; 148/654; 148/644; 148/698; 148/714; 266/250

[58] Field of Search ..... 266/250; 148/159, 145, 148/637, 654

[56] References Cited

U.S. PATENT DOCUMENTS

| | | | |
|---|---|---|---|
| H777 | 5/1990 | Natarajan | 148/128 |
| 2,890,975 | 6/1959 | Lenz | 148/21.56 |
| 3,470,624 | 10/1969 | Plotkowiak | 34/20 |
| 4,610,435 | 9/1986 | Pfau | 266/250 |
| 4,653,732 | 3/1987 | Wunning | 266/250 |
| 4,767,473 | 8/1988 | Berg | 148/159 |
| 4,769,092 | 9/1988 | Peichl | 148/145 |
| 4,810,311 | 3/1989 | Economopoulos | 148/128 |
| 4,938,460 | 7/1990 | Wechselberger et al. | 266/258 |

*Primary Examiner*—Peter D. Rosenberg

*Attorney, Agent, or Firm*—Andrew C. Hess; David L. Narciso

[57] ABSTRACT

Cooling of a workpiece is conducted at selected workpiece locations in accordance with predetermined heat flux, at the locations, required to result in a desired workpiece cooling rate for workpiece integrity, microstructure and mechanical properties. A cooling fluid is controlled to follow the workpiece surface according to preselected cooling fluid convective cooling parameters including, but not limited to, cooling fluid direction, mass flow rate, and velocity at the selected locations.

20 Claims, 3 Drawing Sheets

METHOD AND APPARATUS FOR COOLING A WORKPIECE

BACKGROUND OF THE INVENTION

This invention relates to selectively controlled cooling of a workpiece and, more particularly, to the guiding of a cooling fluid to follow along a workpiece surface for the selective control of convective cooling coefficients between areas of a workpiece as a function of differences in surface areas or mass or both.

It is common practice, for example in the metallurgical art, to heat treat and then cool an article or workpiece for one or more of a variety of reasons. These include cooling to develop desired microstructure and mechanical properties while avoiding physical defects such as cracking, controlling distortion and controlling residual stresses which can impact such characteristics as machinability during manufacture or repair as well as article operating life.

A variety of methods and apparatus for cooling certain workpieces has been reported. However, these are directed or related to the cooling of generally solid workpieces or workpieces of relatively simple shape, or both. Some approaches include varying areas of cooling exterior surfaces of a workpiece, for example, as a function of workpiece thickness. Examples of such reports include U.S. Pat. No. 2,890,975 - Lenz (patented Jun. 16, 1959); U.S. Pat. No. 3,470,624 - Plotkowiak (patented Oct. 7, 1969); U.S. Pat. No. 4,610,435 - Pfau et al (patented Sep. 9, 1986); and U.S. Pat. No. 4,653,732 - Wunning et al (patented Mar. 31, 1987). In other reports, internal and external surfaces of an article, such as a vehicle wheel, are cooled by jets of cooling fluid sequentially directed separately first toward an inside surface and then toward an outside surface, as in U.S. Pat. No. 4,767,473 - Berg (patented Aug. 30, 1988). More particularly in connection with turbomachinery components, such as a simple shaped, single stage, solid rotor disk, jets of cooling fluid from selectively sized and positioned nozzles or orifices have been directed at the external surface of the relatively simple disk, such as in Invention Registration H777 -Natarajan, (published May 1, 1990), or separately at the external surface and at the bore of a simple, single stage disk, as in U.S. Pat. No. 4,769,092 - Peichl, et al (patented Sep. 6, 1988). The disclosures of each of the above reports are hereby incorporated herein by reference.

However, the controlled cooling of a complex sized and shaped workpiece which includes adjacent areas of high and low volume and/or high and low available convective surface area will generally have protrusions which will impede or block the flow of cooling fluid and requires a different cooling method and apparatus than has heretofore been reported. For example, such workpieces have been designed for use in the manufacture of at least a portion of an advanced, drum-like compressor and turbine of a gas turbine engine. These workpieces generally are a combination of articles of revolution with protruding shelves running perpendicular to the axis. Improvement in known methods and apparatus is needed to avoid undesirable cooling fluid velocities along the surface of complex shaped workpiece areas, for example, the recesses, channels, indentations or changes in inflection or shape of a complex workpiece as described above. Although the method and apparatus described herein is particularly suited for use on complex geometries, its use is not limited to such.

SUMMARY OF THE INVENTION

The present invention, in one form, provides a method for cooling a workpiece, particularly one having a complex shaped interior workpiece surface, including steps of predetermining a heat flux for selected workpiece locations required to result in a desired workpiece cooling rate, selecting cooling fluid convection cooling parameters at each location to generate predetermined heat flux, and selectively guiding or controlling cooling fluid flow to follow along the selected locations according to the parameters, preferably while maintaining desired cooling flow characteristics both on a hollow workpiece cooperating interior and exterior surfaces. In a more specific form, the method is adapted for cooling a workpiece shaped as a hollow drum-like article of revolution wherein a plurality of shelves protrude from the inner diameter of the drum. The cooling fluid is guided to flow across selected locations of the workpiece surface, and is controlled in accordance with preselected convective cooling parameters, including fluid direction, mass flow rate, and velocity to provide workpiece cooling consistent with predetermined heat flux for each selected location. This minimizes thermal gradients within the workpiece, controlling cooling rates in areas or locations of different mass and convective area.

The invention, in another form, provides a method for making a metal article which includes a surface of complex shape, in which an article preform is selected of a shape related to and enveloping therein the metal article shape. The shape of the preform is based on a predetermined heat flux, to provide a desired cooling rate, at each of selected preform locations. After preselecting cooling fluid parameters, as described above, the preform is heat treated in accordance with a preselected heat treatment schedule, including the controlled cooling of the preform.

In its apparatus form, the present invention provides guide duct means, generally related in shape to the complex workpiece surface, and adapted so that the distance the guide duct is positioned, in relation with a cooperating workpiece surface, is such that the desired cooling fluid parameters are maintained. This obtains the desired convective heat transfer characteristics at the selected locations on the workpiece surface. As such, the desired cooling rate can be obtained at each selected location on the workpiece thereby yielding required or preselected microstructure and the desired state of residual stress. This produces a preform with the required machinabilty characteristics and mechanical properties. The guide duct means can include appropriately shaped members, such as walls and baffles, to guide and control cooling fluid, according to the cooling fluid parameters, along such a workpiece surface.

DESCRIPTION OF THE PREFERRED EMBODIMENTS

Figure 1:
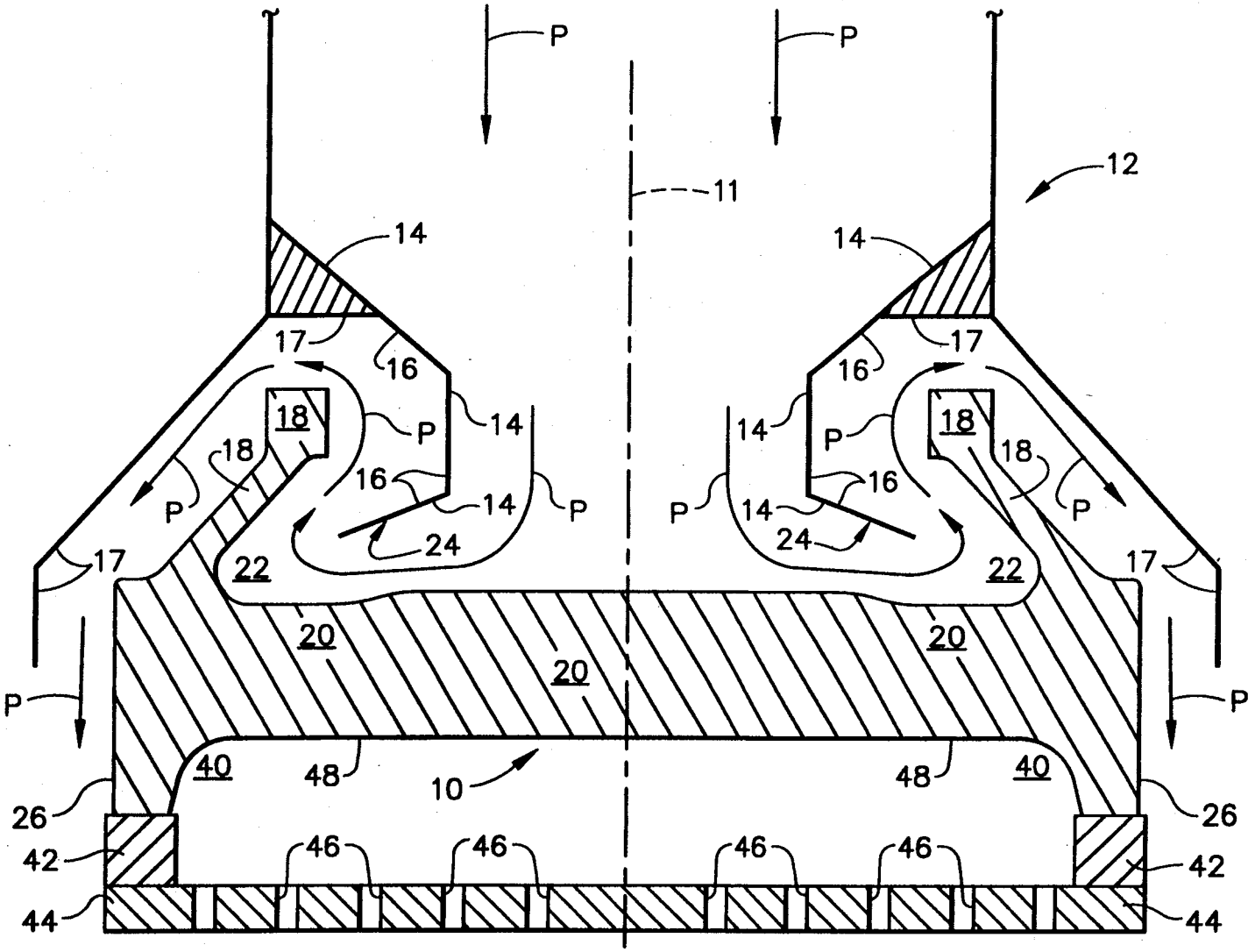
FIG. 1 is a diagrammatic sectional view of a complex shaped interior surface workpiece preform within a guide duct means according to the present invention.

One use of the present invention is in the manufacture of a gas turbine engine spool or drum shaped component included in the compressor section, the turbine section, or both. Such a dram or spool, in its final form or article shape, includes a plurality of blading members projecting from a surface of such member to act on or react with air or gas, such as products of combustion, passing through the engine.

During manufacture of such a component, an appropriately shaped article preform, or plurality of preforms, is produced by casting or forging. Frequently, such a preform is made of a high temperature alloy, such as a nickel based superalloy commonly used in the gas turbine engine art. In order to control and generate the formation of desired alloy microstructure and to develop desired mechanical properties for component strength and life, and machinabilty characteristics such a preform is heat treated by heating according to a preselected heat treatment schedule in a temperature range predetermined by the alloy composition and then cooled. It is desired in such cooling to develop the desired microstructure and mechanical properties. In addition, because there are areas of relatively thin sections adjacent to areas of relatively thick sections of the preform, it is desired to avoid distortion of the preform by uneven or uncontrolled cooling. Therefore, cooling rates can be critical to the integrity of such an engine component.

Historically, relatively simple metallic parts, including gas turbine components, have been cooled by a variety of means including still air cooling, water or oil quenching, forced air cooling, or their combinations. Typical of some such known methods are shown in the above described and incorporated patents and publication. In such known examples, the article was relatively simple in shape, without adjacent thin and thick sections or shelf like protrusions, for example which presented distortion problems or potentially drammatic differences in cooling rates. However, as geometries of gas turbine engine components became more complex, known means of cooling were not able to perform the desired function. Because of non-uniformity of cooling by known methods, mechanical properties and residual stresses could be variable throughout the workpiece. Undesirable distortion from thermally induced residual stresses were likely to occur.

The present invention provides a method and apparatus which enables controlled cooling after heating of complex shaped members. It should be understood, however, that the present invention also provides an alternative method for cooling after heating of relatively simple shaped members. Such controlled cooling is accomplished by predetermining cooling fluid convection cooling parameters including flow direction, mass flow rate and flow velocity as a function of the shape of the member and the heat flux at selected locations along the member surface to provide cooling rates desired for development of mechanical properties and metal microstructure. In this way, the areas of cooling fluid stagnation or loss of convective velocity are avoided, for example, within the recessed surface portion or at a surface protrusion where geometry changes abruptly or just significantly. The apparatus form of the present invention provides covective guide duct means appropriately shaped and positioned to accomplish such controlled cooling.

Figure 2:
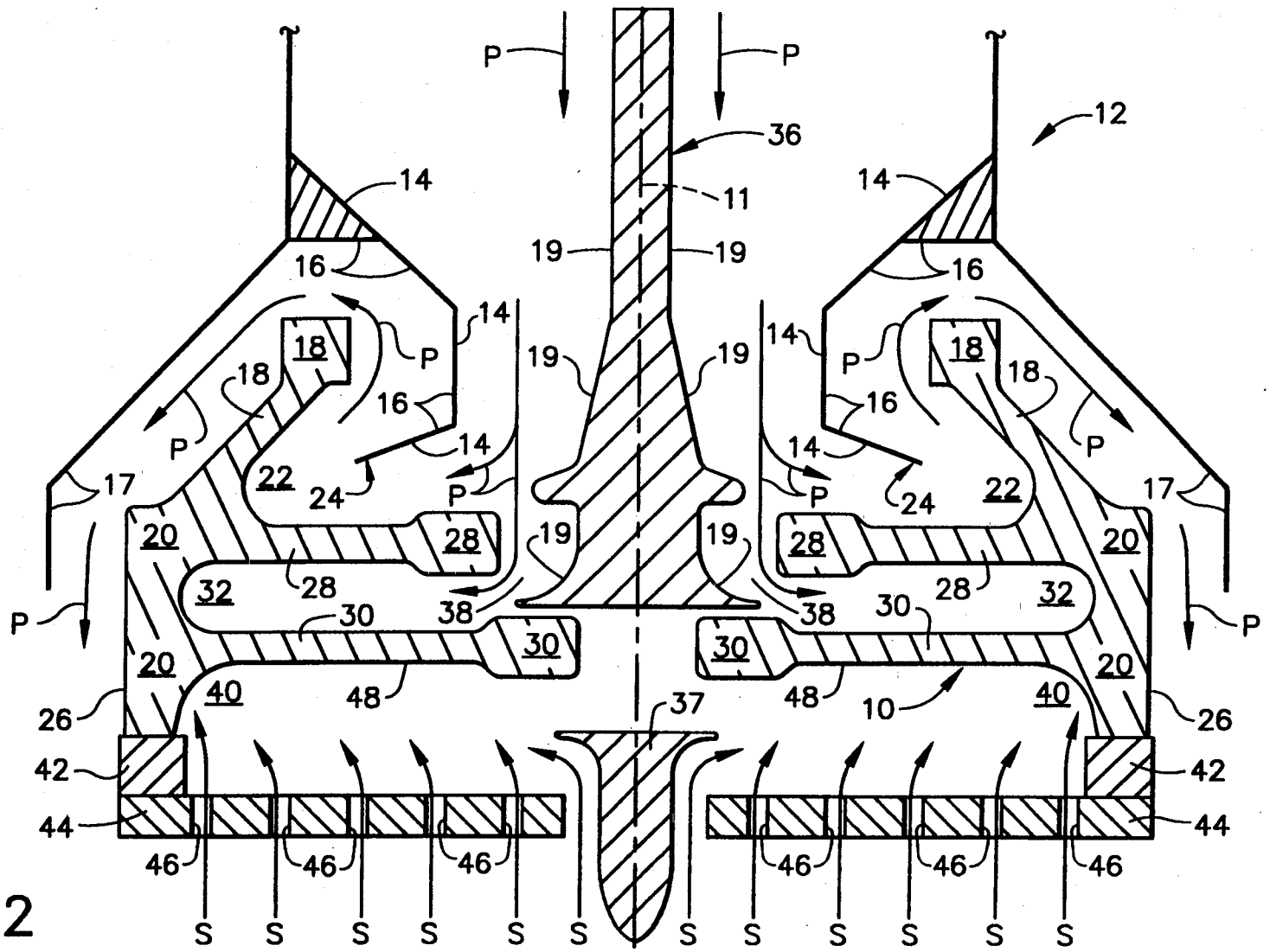
FIG. 2 is a diagrammatic sectional view of a more complex shaped interior surface workpiece preform within a guide duct means according to the present invention including a guide duct means to control cooling fluid flow in a remote cavity and a guide duct means to control a secondary cooling fluid flow.
Figure 3:
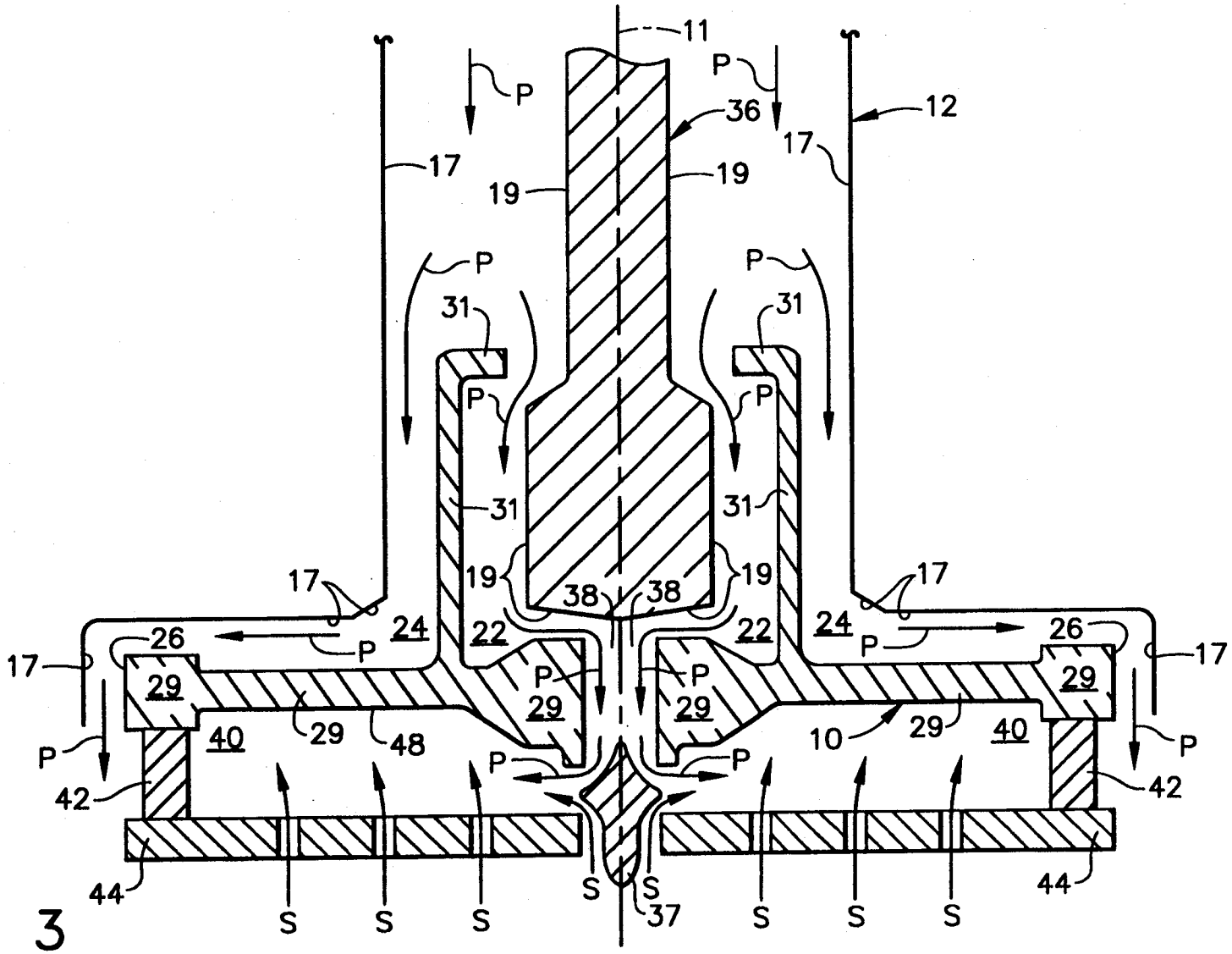
FIG. 3 is a diagrammatic sectional view of a complex interior and exterior surface workpiece preform within a guide duct means according to the present invention including a guide duct means to control a secondary cooling fluid flow.

The diagrammatic sectional views of FIGS. 1, 2 and 3 show a complex shaped workpiece or preform shown generally at 10 as a hollow article or shape of revolution about axis 11. Workpiece 10 is positioned within a guide duct means shown generally at 12, for example, of sheet metal or other appropriate heat resistant material. The guide duct means 12 includes walls or a plurality of walls such as the wall defined by a first guide duct surface 14, a second guide duct surface 16, and, in the embodiments shown in the drawings, a wall defined by a third guide duct surface 17. The guide duct surfaces are generally related in shape to the portions of workpiece 10 with which they are disposed in spaced apart relationship and with which they are in juxtaposition and respectively opposite. With this construction, cooling fluid, the general flow of which is shown by arrows P and S as primary and secondary cooling fluid, respectively, is guided at a controlled, predetermined flow rate and velocity to follow the surface of workpiece 10. Therefore, the phrase "generally related in shape", used herein in respect to the shape of the guide duct means, is intended to include shapes which will guide cooling fluid to flow along and follow a selected surface of the workpiece at a predetermined fluid flow rate and velocity. The predetermined velocity is thus intended to produce a known and controlled heat transfer coefficient and the predetermined flow rate is intended to establish the temperature of the cooling fluid, thereby fixing the desired heat flux Q for an area A for the relationship: $Q/A=h\ (Twp - Tcf)$, where h, the convective heat transfer coefficient; Twp, the temperature of the workpiece; and Tcf, the temperature of the cooling fluid, are set by the guide duct means and controlled cooling fluid flow.

In FIGS. 1 and 2, article preform or workpiece 10 includes at least one shelf-like projection 18 generally circumferentially disposed about and projecting from the interior of body 20 of workpiece 10. In FIG. 1, cooling fluid P entering the guide duct means 12, such as from an air blower (not shown), is first guided by first guide duct surface 14 between the surface of body 20 and surface 14 toward a cavity, recess or channel 22 along the workpiece surface generally at the juncture of the shelf 18 with the body 20. Channel 22 is a potential area for undesirable stagnation for cooling fluid flow along the workpiece surface. A circumferentially disposed wall, shown generally at 24 defined by the juncture and termination of first guide duct surface 14 and second guide duct surface 16, directs and controls flow rate and velocity of primary cooling fluid P along the workpiece surface defining channel 22. This avoids cooling fluid stagnation or undesirable flow velocities in that area and at such workpiece surface. After exiting channel area 22 and guided by second guide duct surface 16, cooling fluid P is directed along and about the balance of the internal surface of spacer 18 and then by third guide duct surface 17 along the external surface of spacer 18 onto the external workpiece surface 26. The labyrinthine shaped cooling passage formed by walls 14, 16, and 17, in cooperation with the workpiece surfaces, produces desirable cooling fluid flow rates and velocities at the interior and exterior surfaces of the workpiece 10 to obtain the desired heat flux for balanced cooling of the workpiece 10.

The views of FIGS. 1, 2 and 3 are intended to be typical of but not limiting on the scope of the present invention. In those figures, guide duct means 12 with its first, second and third guide duct surfaces 14, 16 and 17, respectively, along with appropriately positioned guide duct walls defined by the juncture of surfaces 14 and 16, as well as the combination of guide duct surfaces 16 and 17, controls cooling fluid along the surfaces of workpiece 10. This avoids uneven cooling of the workpiece and stagnation or undesirable cooling fluid flow rates and velocities within channels, recesses and areas of significant change in geometry in a workpiece. As will be recognized by those skilled in the arts to which this invention relates, various walls, baffles, etc., within guide duct means 12 can be positioned to provide such cooling fluid flow control responsive to the particular shape of the workpiece being cooled. Cooling fluid controlled flow is defined herein to include, but not be limited to, controlling the cooling fluid flow direction, mass flow rate and velocity.

In FIG. 2, a still more complex shaped workpiece is shown to have a plurality of shelf-like projections 18, 28 and 30, each circumferentially disposed within and projecting inwardly from body 20 of workpiece 10. The drum or spool-like preform represented by workpiece 10, after completion of manufacture or machining, in one form is a gas turbine engine compressor rotor segment including inwardly projecting strengthening ribs or wheel stubs machined from shelves 28 and 30 and a flange member machined from shelf-like projection 18 for joining the rotor segment to an adjacent engine segment or component. In its final form, the rotor segment of FIG. 2 generally includes a plurality of blading members (not shown) secured to a segment portion machined from workpiece outer surface 26. Therefore the the compressor rotor segment, as a metal article of a predetermined article shape, resides within or is enveloped by the surrounding body of the preform from which excess material is machined to generate the metal article.

The guide duct means 12 in FIG. 2 is shown to be similar to that shown in FIG. 1, even though workpiece 10 in FIG. 2 is more complex and includes additional shelves such as 28 and 30. However, it should be understood that additional guide duct walls and surfaces, similar to wall or baffle 24 in FIG. 1 which directs controlled cooling fluid flow toward channel 22, can be included with and as a part of guide duct means 12 to direct controlled cooling fluid, in the same way, toward and along the surface of channel 32, FIG. 2, defined by surfaces of shelves 28 and 30, or additional channels defined by the surfaces of additional shelves in more complex workpieces. Accordingly, wall 24, terminating in the juncture of first and second guide duct surfaces 14 and 16, respectively, is typical of one or a plurality of guide duct baffles appropriately positioned to direct controlled cooling fluid flow toward recesses, channels, or significant changes in surface geometry, or their combinations, to avoid cooling fluid stagnation or undesirable flow velocities. Wall, baffle or member shown generally at 36 in FIG. 2 shows such a guide duct arrangement which directs controlled cooling fluid flow along surfaces 19 into channels 22 and 32 on a workpiece which includes additional shelves 28 and 30. In this way, one or a plurality of labyrinthine shaped cooling fluid passages are defined within the interior and about the interior surface of such a complex shaped hollow workpiece.

In another form of the guide duct means 12 and workpiece 10 in FIG. 2, additional walls or baffles, such as the above combination of 24 and 36, can be included in the guide duct means 12 to direct primary (P) or secondary (S) controlled cooling fluid flow into and along the surface of channel 40. Accordingly, guide means or plug 37 is positioned to direct controlled secondary cooling fluid flow S to follow along surface 48 of the workpiece and into recess 40 to obtain desirable cooling fluid velocity and flow rate on surface 48 and recess 40. All such walls or baffles, such as are defined by walls or members 14, 16, 17, 36 and 37, can be disposed partially, fully or segmentally circumferentially about the interior of workpiece 10. Member or plug 37 conveniently can be carried, such as by spaced apart vanes (not shown), by heat treatment tray 44.

In FIG. 3, a more complex shaped workpiece 10 is shown to have a wheel-like projection 29, circumferentially disposed, and a hollow drum-like projection 31, extending axially forward ( upward in FIG. 3 ) and attached to the wheel-like projection 29, which acts as a body for projection 31 of workpiece 10. The preform represented by workpiece 10 in FIG. 3, after completion of manufacturing or machining, in one form is a gas turbine rotor segment including an inwardly and outwardly projecting strengthening rib or wheel stub machined from shelf 29 and a flange member machined from drum-like projection 31 for joining the rotor segment to an adjacent engine segment or component. In its final form, the rotor segment of FIG. 3 generally includes a plurality of blading members (not shown) secured to a segment portion machined from outer surface 26 of shelf 29.

The guide duct means 12 in FIG. 3 is shown to be similar in concept and function to that shown in FIGS. 1 and 2, even though workpiece 10 in FIG. 3 embodies a significantly different geometric shape. However, it should be understood that guide duct walls and surfaces, similar to wall or baffle 24 in FIG. 1 which directs controlled cooling fluid flow toward channel 22, can be included with and as a part of guide duct means 12. Such walls and surfaces are intended to direct controlled cooling fluid flow, in the same way, toward and along the surface of channels 22 and 24 of FIG. 3, defined by surfaces of shelves 29 and 31, or additional channels defined by the surfaces of additional shelves in more complex workpieces. Accordingly, guide duct walls 17 and 19, in spaced relation with the exterior surface of member 31, and the surface of member 29, form or define a cooling fluid passage appropriately positioned to direct controlled cooling fluid flow toward channel 24 and onto the exterior surface 26 of workpiece 10. Additionally, guide duct surface 19, in spaced relation with the interior surface of member 31 and surface of member 29, form or define a cooling fluid passage appropriately positioned to direct controlled cooling fluid flow toward channels 22 and 38. Further, primary cooling fluid flow then exits channel 38 and is directed toward, and thereby combined with, the secondary flow by guide plug or member 37, to flow along surface 48 of member 29 and into recess 40 to obtain desirable cooling fluid velocity and flow rate on surface 48 and recess 40. All such walls or baffles, for example as defined by walls or members 17, 19, and 37 in FIG. 3, can be disposed partially, fully or segmentally circumferential about the interior or exterior, or both, of workpiece 10.

In use of the present invention, workpiece 10 conveniently is mounted on a spacer 42, carried by a heat treatment tray 44. Tray 44 can include openings, holes, slots, etc. 46 to enable cooling of surface 48 of workpiece 10 by directing another supplemental flow of cooling fluid through openings 46 toward surface 48 as well as toward recess 40. Guide duct means defined by walls, members and baffles 14, 16, 17, 19, 36 and 37 in FIG. 2, and 17, 19, and 37 FIG. 3, can be included as part of the controlled secondary cooling flow circuit to provide specific flow direction, velocities, and flow rates at surface 48 and recess 40 of workpiece 10.

As a result of the practice of the present invention, a relatively constant, controlled heat transfer is provided from the workpiece or preform in order to avoid distortion of workpiece portions from uneven or non-constant cooling. For example, uncontrolled cooling could result in such members as 18, 28, 29, 30, or 31, or combinations of such members in the drawings, moving away or distorting from designed positions. Sometimes such distortion is referred to as "oil canning". The customized, controlled cooling fluid flow according to the present invention, preserves article shape, while maintaining desired thermal stresses and microstructure in the article.

An example of the practice of this invention is demonstrated using the disk workpiece shown in FIG. 1. The component, when finished, makes up part of a compressor rotor of a gas turbine engine. It is manufactured from a typical nickel base superalloy of the type identified above and from which this type of component typically is manufactured. The disk is manufactured from the inward projection 20 of FIG. 1, while the conical projection 18 provides an attaching flange where this component is bolted to another rotor component. When completed, dovetails are machined into the outer surface, 26, and a plurality of airfoils are attached these dovetails. Such airfoils are used to compress air in the engine flowpath, for example, prior to entering a combustion chamber.

In this example, it is important that the disk be cooled at a rate, in relation to the spacer arm and flange, so as not to induce excessive residual stresses by unbalanced cooling. The spacer arm and flange, being thinner, will cool too fast in relationship with the disk if a constant, same cooling rate is applied to all surfaces. Additionally, all material in the workpiece volume must be cooled at a sufficient rate to obtain the desired microstructure and resulting mechanical properties.

The required heat flux was predetermined in this example using finite element heat transfer analyses or non-dimensional temperature response charts generally found in typical heat transfer text books. The goal was to obtain desired proper absolute and differential cooling rates in the workpiece to enable practice of the present invention. For this example, the average heat flux requirements were calculated at the surfaces of disk web 20, the spacer arm 18, the flange at the end of the spacer arm, and the disk rim surface 26. These were as follows:

| Workpiece Location | Heat Flux (BTU/hr) |
|---|---|
| disk web, 20 | 346,800 |
| spacer arm, 18 | 32,830 |
| spacer flange, 18 | 20,380 |

-continued

| Workpiece Location | Heat Flux (BTU/hr) |
|---|---|
| disk rim, 26 | 172,890 |

For this example, the initial temperature of the workpiece and the cooling fluid were known. The convective heat transfer coefficient, h, could then be determined from the component geometric convective surface area and the required heat flux for each selected location. These were as follows:

| Workpiece Location | Heat Flux (BTU/hr × sq ft × °F.) |
|---|---|
| disk web, 20 | 59.7 |
| spacer arm, 18 I.D. | 7.6 |
| spacer flange, 18 I.D. | 15.0 |
| spacer flange, 18 face | 12.5 |
| spacer flange, 18 O.D. | 12.5 |
| spacer arm, 18 O.D. | 7.6 |
| disk rim, 26 O.D. | 38.3 |

Once the convective heat transfer coefficients were determined at each selected location or area, the cooling fluid flow velocity was calculated. For this example, the cooling fluid was assumed to be air from a fan system which developed a flow of 9100 cubic feet per minute. The basic equations relating the convective heat transfer coefficient to the cooling fluid physical properties and velocity were used. For this example, the following equations for plate flow and duct flow were used:

$$\text{Plate Flow: } h = \frac{.0296k}{L} \frac{(\rho VL)^{.8}}{\mu} Pr^{3}$$

$$\text{Duct Flow: } h = \frac{.023k}{D} \frac{(\rho VD)^{.8}}{\mu} Pr^{3}$$

where:

h=the convective heat transfer coefficient k=the thermal conductivity of the cooling fluid $\rho$=the density of the cooling fluid $\mu$=the absolute viscosity of the cooling fluid Pr=Prandtl Number L=the characteristic length of the plate D=the characteristic diameter of the duct Given the physical properties of air and the previously calculated convective heat transfer coefficients at each location, the cooling fluid velocities were calculated using the above two equations. These were as follows:

| Workpiece Location | Velocity (ft/minute) |
|---|---|
| disk web, 20 | 27,970 |
| spacer arm 18 I.D. | 3,110 |
| spacer flange 18 I.D. | 7,650 |
| spacer flange 18 face | 2,800 |
| spacer flange 18 O.D. | 6,470 |
| spacer arm 18 O.D. | 3,630 |
| disk rim, 26 O.D. | 12,750 |

Given the total fan flow and the required velocities, the duct flow areas were then calculated and the duct was designed to yield the required cooling characteristics at all selected locations on the workpiece. The duct flow areas in this example were as follows:

| Workpiece Location | Area (sq. ft.) |
|---|---|
| disk web, 20 | 0.33 |
| spacer arm, 18 I.D. | 2.93 |
| spacer flange, 18 I.D. | 1.18 |
| spacer flange, 18 face | 3.25 |
| spacer flange, 18 O.D. | 1.40 |
| spacer arm, 18 O.D. | 2.50 |
| disk rim, 26 O.D. | 0.71 |

Thus, in this example according to the present invention, the duct was sized in relationship with the available cooling fluid flow rate to yield cooling rates necessary to produce required workpiece mechanical properties, while balancing the cooling rates throughout the workpiece to avoid undesirable workpiece residual stresses.

The present invention has been described in connection with specific examples and embodiments. However, those skilled in the arts to which this invention relates will recognize that the present invention is capable of other variations and modification within its scope. Some of these, such as the use of additional members, such as walls, plugs, or baffles, in the guide duct means, have been mentioned in the above description in connection with more complex shaped workpieces. The examples herein are intended as typical of, rather than in any way limiting on, the scope the present invention as presented in the appended claims. Further, one skilled in the arts to which this invention relates should recognize that any cooling fluid can be used with this means to control fluid flow parameters thereby to avoid fluid stagnation and other undesirable characteristics which can result without the above described control. Oil, water, nitrogen, argon, and air are but a few examples of such fluids.

We claim:

1. In a method of cooling a workpiece with a cooling fluid flowing along a surface of the workpiece, the steps of:

selecting on the workpiece surface a plurality of spaced apart workpiece locations defining at least a part of a shape of the workpiece;

predetermining for each of the selected workpiece locations a heat flux required to result in a desired workpiece cooling rate at each location;

selecting at each selected location cooling fluid convection cooling parameters, including fluid flow direction, mass flow rate and velocity, required to generate the predetermined heat flux from the workpiece at each location; and then, controlling cooling fluid flow to follow along the workpiece selected locations to provide the cooling fluid parameters for each selected location to selectively control cooling of the workpiece.

2. The method of claim 1 in which the workpiece has an interior surface of complex shape defining a workpiece hollow interior and a workpiece exterior surface, wherein:

the selected locations define at least a part of the workpiece hollow interior; and, the cooling fluid flow is controlled to follow along the selected locations on the workpiece interior surface.

3. The method of claim 2 in which, in addition, secondary cooling fluid is provided and controlled to flow toward a second plurality of selected locations defining an area of shape change of the workpiece surface.

4. The method of claim 2 in which:

the selected locations define at least a part of the workpiece hollow interior and at least a part of the exterior surface; and, the cooling fluid is controlled to follow along the selected locations both on the the workpiece interior surface and on the exterior surface.

5. The method of claim 4 in which the cooling fluid is controlled to follow first along the selected locations on the interior surface and then along the selected locations on the exterior surface.

6. The method of claim 1 for the controlled cooling of a workpiece surface including at least one shelf projecting therefrom, the shelf having a shelf surface, wherein the cooling fluid is controlled to follow along the shelf surface.

7. The method of claim 6 in which the workpiece is shaped as a hollow drum-like article of revolution having a workpiece surface defining a hollow interior and the at least one shelf projecting from the workpiece surface is disposed generally circumferentially about the workpiece surface within the hollow interior, wherein the cooling fluid is controlled to follow along the workpiece surface and the shelf surface.

8. The method of claim 6 in which the workpiece is shaped as a hollow drum-like article of revolution having a first workpiece surface defining a hollow interior and a second workpiece surface defining a workpiece exterior surface, and the at least one shelf projecting from the workpiece surface is disposed generally circumferentially about the workpiece exterior surface, wherein the cooling fluid is controlled to follow along the workpiece exterior surface and the shelf surface.

9. The method of claim 8 in which at least one shelf projects from the first workpiece surface and at least one shelf projects from the second workpiece surface, and the cooling fluid is controlled to follow along the surfaces of the workpiece interior and the workpiece exterior and along the surfaces of the shelves.

10. The method of claim 9 in which the cooling fluid is controlled to follow first along the interior surface and then along the exterior surface.

11. The method of claim 1 for making a metal article of a predetermined article shape, including the steps of:

first selecting an article preform of a preform shape related to and enveloping therein the article shape, the preform shape being based on a predetermined heat flux at selected preform locations to provide a desired cooling rate at each of the selected locations, selecting the cooling fluid parameters at each preform location to generate the predetermined heat flux at each location; and then, heat treating the preform shape in accordance with a preselected heat treating schedule including cooling the preform with a cooling fluid flow controlled to follow along a surface of the preform at the preform locations.

12. The method of claim 11 in which the article shape and the preform shape include a hollow interior surface of complex shape and the selected locations define at least a portion of the hollow interior surface of the preform.

13. The method of claim 11 in which the article shape and the preform shape include an exterior surface of complex shape and the selected locations define at least a portion of the exterior surface of the preform.

14. In a method of cooling with a cooling fluid a workpiece having a workpiece interior surface of complex shape defining a workpiece hollow interior, and a workpiece exterior surface, the steps of:

guiding primary cooling fluid to follow along at least a portion of the workpiece interior surface; and, guiding the primary cooling fluid to follow along at least a portion of the workpiece exterior surface.

15. In the method of claim 14, the steps of:

disposing about the workpiece surface a guide duct means including a plurality of guide duct surfaces spaced apart from and shaped to relate to the workpiece surface with which it cooperates to define a labyrinthine cooling passage between the workpiece surface and the guide duct surface, the cooling passage generally related in shape to the workpiece surface; and, controlling a cooling fluid flow through the cooling passage and along the workpiece surface.

16. In the method of claim 15, the steps of:

disposing, within the hollow interior, guide duct means including a first guide duct surface and a second guide duct surface, the second guide duct surface being in juxtaposition with and in spaced apart relationship with the workpiece interior surface to define a cooling fluid passage between the second guide duct surface and the workpiece interior surface, the second guide duct surface having a guide shape generally related to the workpiece interior surface shape; and, guiding a cooling fluid through the guide duct means first along the first guide duct surface and then into the cooling fluid passage and along the second guide duct surface and toward the workpiece interior surface.

17. Apparatus for applying controlled cooling fluid to a workpiece having a workpiece interior surface defining a workpiece hollow interior, and a workpiece exterior surface, comprising:

guide duct means having a first guide duct portion which includes a first guide duct surface and a second guide duct surface, the second guide duct surface adapted to be disposed within the workpiece hollow interior in spaced apart relationship with the workpiece interior surface to form a first cooling fluid passage between the workpiece interior surface and the second guide duct surface, the second guide duct surface having a guide shape generally related to the shape of the workpiece interior surface; and, means to control the flow of primary cooling fluid through the guide duct means in accordance with preselected cooling fluid convective cooling parameters including fluid flow direction, mass flow rate and velocity at a plurality of spaced apart selected workpiece locations on the workpiece interior surface;

whereby the primary cooling fluid within the first cooling fluid passage is guided to flow along and follow the shape of the workpiece interior surface.

18. The apparatus of claim 17 in which:

the guide duct means has a second guide duct portion which includes a third guide duct surface adapted to be disposed about and in spaced apart relationship with at least a portion of the workpiece exterior surface to define a second cooling fluid passage between the third guide duct surface and the portion of the workpiece exterior surface, the third guide duct surface having a guide shape generally related to the shape of the portion of the exterior surface; and, means to control the flow of primary cooling fluid through the second cooling passage in accordance with preselected cooling fluid convective cooling parameters including fluid flow direction, mass flow rate and velocity at the selected workpiece locations on the exterior surface, whereby the primary cooling fluid within the first cooling fluid passage is controlled to flow along and follow the shape of the workpiece interior surface, and then is controlled to flow into the second cooling fluid passage and along and follow the shape of the portion of the workpiece exterior surface.

19. Apparatus for applying a cooling fluid to a workpiece having a workpiece interior surface defining a workpiece hollow interior, and a workpiece exterior surface, at least one of the surfaces having a complex shape, comprising:

a plurality of walls for controlling cooling fluid flow about the interior surface, cooperating with and generally related in shape to portions of the workpiece interior surface in spaced apart relationship therewith to define a first labyrinthine cooling passage about the workpiece interior surface;

a plurality of walls for controlling cooling fluid flow about the exterior surface, cooperating with and generally related in shape to portions of the workpiece exterior surface in spaced apart relationship therewith to define a second labyrinthine cooling passage about the workpiece exterior surface; and, means to pass controlled cooling fluid flow through the guide duct means in accordance with preselected cooling fluid convective cooling parameters including fluid flow direction, mass flow rates and velocity at a plurality of spaced apart selected workpiece locations on the workpiece surface;

whereby the cooling fluid within the cooling passages is controlled to flow along and follow the workpiece interior and exterior surfaces.

20. The apparatus of claim 19 for applying cooling fluid to a workpiece having a workpiece surface which includes at least one shelf projecting therefrom and defined by a shelf surface, wherein:

the guide duct means generally is related in shape to the shelf and adapted to be disposed about and in spaced apart relationship with the shelf;

whereby the cooling fluid is controlled to flow along and follow the shelf surface.

* * * * *